US006022582A

United States Patent [19]

Van Tyle

[11] Patent Number: 6,022,582

[45] Date of Patent: Feb. 8, 2000

[54] METHOD OF APPLYING TEMPORARY MASKING COATINGS BY RUBBING APPLICATION OF A SOLID MASKANT

[76] Inventor: Peter R. Van Tyle, 17 E. Elizabeth St., Skaneateles, N.Y. 13152

[21] Appl. No.: 09/198,303

[22] Filed: Nov. 23, 1998

Related U.S. Application Data

[60] Provisional application No. 60/069,407, Dec. 18, 1997.

[51] Int. Cl.[7] ..... B05D 1/26; B05D 1/32

[52] U.S. Cl. ..... 427/11; 427/154; 427/282; 427/284

[58] Field of Search ..... 427/11, 282, 284, 427/154; 222/386, 390; 401/171, 176

[56] References Cited

U.S. PATENT DOCUMENTS

| | | | |
|---|---|---|---|
| 2,365,705 | 12/1944 | Jeri | 427/282 |
| 3,933,708 | 1/1976 | Brinkman . | |
| 4,315,957 | 2/1982 | Hereth et al. . | |
| 4,336,345 | 6/1982 | Lewis et al. | 525/107 |
| 4,430,137 | 2/1984 | Jones | 427/143 |
| 4,637,309 | 1/1987 | Cafferty . | |
| 4,652,163 | 3/1987 | Karliner et al. . | |
| 4,882,874 | 11/1989 | Paulson | 427/68 |
| 5,066,022 | 11/1991 | Harrington | 222/390 |
| 5,441,769 | 8/1995 | Ryan | 427/282 |
| 5,523,117 | 6/1996 | Woodhall et al. | 427/156 |
| 5,556,010 | 9/1996 | Halm | 401/171 |
| 5,618,582 | 4/1997 | Van Winckel | 427/259 |
| 5,750,190 | 5/1998 | Woodhall et al. | 427/156 |
| 5,821,291 | 10/1998 | Blackburn et al. . | |

FOREIGN PATENT DOCUMENTS

| | | |
|---|---|---|
| 99/07483 | 2/1999 | WIPO . |

*Primary Examiner*—Fred J. Parker
*Attorney, Agent, or Firm*—Trapani & Molldrem

[57] ABSTRACT

This invention relates to the provision of a paint mask in the form of a stick which is housed in a lip balm or stick deodorant type of dispenser. The invention provides for the supply of a paint mask in the form of a stick constructed for immediate and convenient use by application to the surface of glass or other base to be protected from inadvertent paint. Such an application is especially suited for painting window frames and mullions while prohibiting paint to affix itself to the glass. The invention provides for the direct application of a paint mask coating onto the material to be protected, which coating does not permit paint to adhere to the underlying surface. The present invention's ease and accuracy in application and absence of any required period for drying or setting-up overcomes the disadvantages present in spraying, squeezing, rolling and brushing liquid paint masks. The painter may conveniently grip the paint mask stick dispenser and rub the tool end of the dispenser onto targeted areas of the surface to be protected. After paint is applied and dried the paint is simply wiped away with a cloth. The use of razorblades or other instruments which might damage the underlying surface, is obviated.

9 Claims, No Drawings

METHOD OF APPLYING TEMPORARY MASKING COATINGS BY RUBBING APPLICATION OF A SOLID MASKANT

This application claims the benefit of U.S. Provisional Application No. 60/069,407 filed Dec. 18, 1997.

STATEMENT REGARDING FEDERALLY SPONSORED RESEARCH OR DEVELOPMENT

Not applicable

BACKGROUND OF THE INVENTION

Painting window frames is a tedious and time-consuming task as the painter desires to fully cover the window frame while avoiding getting the paint on the window pane itself. Often, windowpane glass is separated by narrow dividers known as mullions. The mullion is a slender member placed between adjacent panes of glass supported by a flange and held in place by putty, caulk or a narrow strip of wood that covers the outside edge of the glass adjacent the mullion. When the window frame or mullions are painted, the paint which otherwise gets on the window pane must be thoroughly removed.

Past efforts at keeping paint from getting onto the windowpanes had been accomplished by masking the glass with tape along the perimeter of the pane where glass meets frame or mullion. When masking, an adhesive coating or tape is placed on the windowpane so that the trim or frame material can be painted quickly and without regard to the juncture between glass and trim since any excess paint will be applied to the protective coating. However, taping is laborious and time consuming and removing the tape from the glass often presents problems, particularly where the tape hardens or becomes tacky. Where tape has not been employed, paint must be scraped off the glass, typically with a razor blade. Another method of masking involves a triangular mask with an adhesive strip around the perimeter. The triangular mask is applied to the glass surface and overlapped to cover the entire surface with a portion of the mask. Portions that overlay the mullions would need to be cut off so as not to interfere with the painting of the frames. Another device provides a flexible narrow blade with a straight edge that contacts the mullion. The ends of the blade are cut at an oblique angle. Two adjacent blades join at a corner of the window. A rubber vacuum cup attaches to each of the blades for securing the blade to the glass. Another device has a spring clip which engages opposed mullions frictionally. The clip presses a cardboard paint shield firmly against the adjacent windowpane. Another device involves a fitting that permits the application of caulk along the perimeter of the pane which may be peeled off subsequent to painting. Yet another window mask product consists of a razor blade mounted on a squeeze bottle containing a liquid paint mask composed of petroleum distillates, which mask is applied to the window's perimeter through a sponge applicator pad and left to dry. After the mullions and frame are painted the paint and mask drippings are scraped off with the attached razor blade.

Each of the foregoing paint mask efforts is plagued with drawbacks. The triangular shield designed to fit over the glass must be cut to size and the overlaps of triangular sections leave gaps that allow paint to seep onto the glass. The blade-style shield alluded to are labor intensive and require accurate positioning of adjacent shields to protect the glass surface. The cardboard shield becomes damp with paint and losses its effectiveness to seal the glass from painting. A spring clamp must be inserted to hold the cardboard sheet to the window. The caulk applicator requires the costly purchase of caulk, the manipulation of a relatively cumbersome caulk applicator, caulk build-up within the applicator, and time-consuming cleanup following caulk application. The razor blade/squeeze bottle method suffers the disadvantage of dripping, it requires time to dry onto the protected surface prior to painting, its petroleum distillate composition is an irritant to skin and eyes, and the use of a razor blade to remove paint scratches treated and energy efficient glass.

Commercial efforts at paint masking include the use of masking tape, caulk, masking paper and liquid paint masks. The liquid paint masks are applied by spraying, sponging, brushing or rolling. Hand-held portable paint mask applicators include a hand-held masking machine which applies masking paper to a desired location, and a fitted nozzle for a caulk gun that permits a bead of caulk to be applied along a window pane's edge and later peeled away. Accordingly, there is a need in the art for an improved mask for glass to prevent painting the glass while painting mullions.

BRIEF SUMMARY OF THE INVENTION

The present invention meets the need in the art by providing paint mask in a semi-solid form that renders a convenient paint spot-mask for windows. The mask is applied as waxy film along the perimeter of a windowpane and thereafter wiped off along with any errant paint. The paint mask comprises a wax-like stick, not unlike those found in lip balms and glue sticks. The stick may contain glycol or other substances that retard paint adhesion, and be of such rigidity that it leaves a film upon the glass by means of dragging the stick's end along the glass' surface. Following painting, the film disadheres from the glass by wiping it with a cloth. The dispenser stick is encased in an applicator resembling a lip balm or glue stick dispenser and the mouth of the applicator has at least one corner whose angle measures 90 degrees or less to fit easily into right-angled window frames. The method of the present invention will be useful to painting contractors, homeowners, hobbyists, or anyone who paints non-glass materials adjacent to glass-like surfaces rapidly and inexpensively.

DETAILED DESCRIPTION OF THE INVENTION

A waxy paint mask stick extruding from the opening of a lip balm type applicator is to be dragged across glass and shear off to deposit a film that is minimally adhesive to paint. The paint mask may contain glycerin and glycols which are widely favored as a constituent of liquid paint masks. Derivatives of polyhydric alcohols, such as sorbitol and glycerin and polyglycol esters of fatty acids and glycols such as (a) ethylene glycol (b) diethylene glycol (c) triethylene glycol (d) propylene glycol (e) dipropylene glycol and (f) tripropylene glycol, display the hygroscopic property of moisture retention, making them minimally adhesive to materials like glass. A hygroscopic glycol mixed with a solid alkali metal salt or similar waxy medium lends itself to precise and uniform film deposit onto the surface of a material to be protected. Most fatty acids when subjected to saponification and laced with a glycol will render an adequate paint masking solid suitable for the type of hand-held application anticipated by the present paint masking process. When the masking stick is rubbed onto the surface of glass it leaves a film that can thereafter be rinsed away with water or simply wiped away with a dry cloth.

It is anticipated that the paint mask stick will advance and retract within a pocket-sized container; to wit, a block-shaped lip balm-type dispenser with a moisture locking cap and plunger base. The base advances the paint mask stick out of the top of the dispenser as it is used, and may be sealed with a cap for closing the same to prevent the solid stick composition from drying out. The container's aperture shall be angular and conform to the shape of the tool end of the stick such that paint mask may provide paint mask coverage in corners. The particular embodiment was chosen in that it provided the means to spot mask selected areas on glass with the convenience of a hand-held tool. The paint mask stick described above has been found to provide a most convenient form of paint mask when used prior to brush-painting window mullions and frames. The paint mask stick is simply dragged across the surface of a glass windowpane along the perimeter formed by frames or mullions.

Changes may be made to modify the substance dispensed from the masking stick and various additives may be incorporated in the paint mask composition to impart desirable attributes without altering the essential advantages offered by employing a paint mask in dispensable stick form and a unique method of mask application.

DESCRIPTION OF THE PREFERRED EMBODIMENTS

In the preferred embodiment the film-depositing stick is packaged in a lip balm or glue-stick type dispenser with a cap and plunger base. The holder is shaped like a block-shaped rather than cylindrical so that the squared tool end of the block-shaped mask stick can deposit paint mask in the window pane corners where mullions or frames meet. A film of paint mask is applied directly from the dispenser to glass by dragging the exposed tool portion of the stick across the glass' surface.

The present invention has been described above with reference to a preferred embodiment. However, those skilled in the art will recognize that changes and modifications may be made in this preferred embodiment without departing from the scope of the present invention. Rather any and all changes and modifications, which are obvious to those skilled in the art, are intended to be included within the scope of the present invention.

I claim:

1. A process of temporarily masking a surface to be protected from paint, varnish, or other coating material and later removing the masking; comprising the steps of applying a film of a substantially solid mask material onto said surface to be protected, said mask material displaying a hygroscopic property of moisture retention so as to be minimally adhesive on glass and on previously painted surfaces and displaying a property of producing a substantially uniform film on said surface when said mask material is dragged across it; said mask material being applied by dragging a stick of said mask material across said surface to be protected; applying said coating material; and thereafter removing said mask material together with any adhered coating material from said protected surface.

2. The process according to claim 1, wherein said removing is carried out by rubbing away said material with a cloth.

3. The process according to claim 1, wherein said removing is carried out by rubbing.

4. The process according to claim 1, wherein said stick has an angular profile with one corner whose angle is 90 degrees or less, so that it may provide mask coverage into corners.

5. A process of temporarily masking a surface from paint, varnish or other coatings according to claim 1 wherein said masking coating is rinsed away with water.

6. A process of temporarily masking a surface from paint, varnish or other coatings according to claim 1 wherein the masking material comprises a derivative of polyhydric alcohols selected from the group consisting of sorbitol and glycerine.

7. A process of temporarily masking a surface from paint, varnish or other coatings according to claim 1 wherein the masking material comprises a derivative of polyglycol esters of fatty acids and glycols selected from the group consisting of (a) ethylene glycol (b) diethylene glycol (c) triethylene glycol (d) propylene glycol (e) dipropylene glycol and (f) tripropylene glycol.

8. A process of temporarily masking a surface from paint, varnish or other coatings according to claim 1 wherein the surface temporarily masked is glass.

9. A process of temporarily masking a surface from paint, varnish or other coatings according to claim 1 wherein the masking material comprises a mixture of a hygroscopic glycol with a saponified fatty acid.

* * * * *